US007857949B2

(12) United States Patent
Closset et al.

(10) Patent No.: US 7,857,949 B2
(45) Date of Patent: Dec. 28, 2010

(54) SACRIFICIAL ANODE WITH RESISTOR ASSEMBLY FOR METAL TANK CORROSION PROTECTION

(76) Inventors: Bernard Closset, Route de Covery 3, Meinier (CH) CH-1252; Klaus Geratsdorfer, Darsser Bogen 4, Berlin (DE) D-13088

( * ) Notice: Subject to any disclaimer, the term of this patent is extended or adjusted under 35 U.S.C. 154(b) by 507 days.

(21) Appl. No.: 12/021,566

(22) Filed: Jan. 29, 2008

(65) Prior Publication Data

US 2009/0188787 A1 Jul. 30, 2009

(51) Int. Cl.
*C23F 13/10* (2006.01)

(52) U.S. Cl. ..... 204/196.11; 204/196.36; 29/746

(58) Field of Classification Search ..... 204/196.11, 204/196.36; 29/746
See application file for complete search history.

(56) References Cited

U.S. PATENT DOCUMENTS 2,568,594 A * 9/1951 Robinson ..... 204/196.11
4,093,529 A * 6/1978 Strobach ..... 204/196.11
4,786,383 A * 11/1988 Houle ..... 205/731
5,256,267 A * 10/1993 Roden ..... 204/196.11
5,334,299 A * 8/1994 Roden ..... 204/196.11
5,335,311 A * 8/1994 Groothuizen ..... 204/196.11
7,017,251 B1 * 3/2006 Murphy ..... 29/458
7,387,713 B2 * 6/2008 Marcelino et al. ..... 204/196.11
2007/0125640 A1 * 6/2007 Marcelino et al. ..... 204/196.01
2007/0272544 A1 * 11/2007 Bytyn ..... 204/196.11
2009/0179025 A1 * 7/2009 Knoeppel et al. ..... 219/481

* cited by examiner

*Primary Examiner*—Bruce F Bell

(57) ABSTRACT

A sacrificial metal anode device incorporating a resistor assembly into the construction of the sacrificial anode is insertable into a metal water storage tank. The metal water storage tank designed to contain heated water is thereby protected from corrosion by the sacrificial metal anode. The sacrificial metal anode device comprising an elongated metal anode member with a metal wire core, an insulating sleeve secured over the elongated metal anode member wherein said insulating sleeve has an external wall with threads to fixedly secure a metal cap. The metal cap having threads on an internal wall to fixedly secure the insulating sleeve further including a cylindrical receptacle for receipt of an end of the elongated metal anode member and an electrical resistor assembly.

20 Claims, 2 Drawing Sheets

SACRIFICIAL ANODE WITH RESISTOR ASSEMBLY FOR METAL TANK CORROSION PROTECTION

FIELD OF THE INVENTION

The present invention relates to a sacrificial metal anode. More particularly, the present invention relates to a device incorporating a resistor assembly into the construction of the sacrificial anode.

BACKGROUND OF THE INVENTION

Most conventional fluid storing containers tend to be made of metal, which can be easily corroded during its lifetime of use. In order to extend the operational life of these fluid storing containers, galvanic protection may be provided to the inner metal wall surface of the containers to slow the onset of corrosion. This corrosion protection may be achieved by implanting sacrificial anodes into the fluid storing containers. The protection is achieved by way of dissimilar electrochemical potentials between the metal of the anode and the metal of the fluid storing container. In addition, the fluid that is stored (i.e. water) serves as an electrolyte ensuring an electron flow between the anode and the container. The anode metal is electronegative and is generally composed of Mg, Al, or Zn while the fluid container is generally composed of steel thereby resulting in a small electromotive force between the anode and the tank. This electromotive force inhibits the corrosion of metal container by cathodically protecting the metal container, and in turn, the anode is slowly consumed or sacrificed.

One of the main concerns of the water heater manufacturer is the life of the anode. The life of an anode is inversely dependent on the amount of electromotive force it generates to cathodically protect the metal container. In many fresh water supplies, particularly in water supplies with high mineral content, the electromotive force generated by the anode is quite high resulting in a quicker depletion of the anode. In order to control the electromotive force of generated by an anode, resistor devices have been incorporated into the anode, and electrically connected between the anode and the protected fluid container, to automatically control the amount of electromotive force generated by the anode thereby increasing the operational life of the anode. Although resistor coupled anodes tends to have a longer operational life, the construction of this device tends to be complex, the assembly of this device tends to difficult, and the fabrication of this device tends to be expensive. Prior art has attempted to solve the problems listed above by disclosing a sacrificial anode assembly, which comprises of a cylindrical metal anode member having an end retained within a cylindrical plastic insulating sleeve which, in turn, is captively retained with a metal cap portion. In order to regulate the current flow from the anode, a barrel-shaped resistor is incorporated into the assembly and is interconnected between the anode and the cap portions. The cylindrical plastic insulating sleeve has a generally U-shaped groove formed in a closed end, with one leg of the groove extending diametrically across a central opening in the sleeve end that receiving a core portion of the anode member, and the other groove leg extending chordwise relative to the sleeve end. The resistor body is received within the chordwise groove leg, and a lead wire of the resistor is extended through the curved and diametrically extending groove portions and spot welded to the core wire portion received in the central sleeve end opening.

Although this method of incorporating the resistor into an anode assembly may reduce the amount of time and cost of assembling such a device, and provides the desired regulation of anode current generation, the structure of the device is still quite complex and difficult to assemble. The proposed assembly need not require any welding/soldering of the resistor wire to the metallic core.

From the foregoing, it can be seen that there is a need to produce a simpler, less complex resistor coupled sacrificial anode devices thereby decreasing the difficulty of assembly of such a device.

SUMMARY OF THE INVENTION

The present invention provides for a sacrificial anode assembly insertable into a liquid storage tank or vessel for cathodic protection, comprising: an elongated metal anode member with a metal wire core extending axially therethrough from an upper neck section to a main body section wherein the upper neck section of said elongated metal anode is of a reduced diameter to that of the main body section; an insulating sleeve secured over the upper neck section of the elongated metal anode member wherein said insulating sleeve has an external wall with threads to fixedly secure a metal cap; the metal cap having: threads on an internal wall of said metal cap to fixedly secure said metal cap to the insulating sleeve; a cylindrical receptacle for receipt of an end of the upper neck section of the elongated metal anode member and an electrical resistor assembly; and the electrical resistor assembly disposed within the metal cap comprising: a barrel-shaped resistor body located in the centre of a plastic ring; two lead wires welded respectively to an upper metallic plate and a lower metallic plate separated by the plastic ring.

BRIEF DESCRIPTION OF THE DRAWINGS

A detailed description of one or more embodiments is provided herein below by way of example only and with reference to the following drawings, in which.

In the figures, one or more embodiments of the present invention are illustrated by way of example. It is to be understood that the description and drawings are only for the purpose of illustration and as an aid to understanding, and are not intended as a definition of the limits of the present invention.

DETAILED DESCRIPTION OF THE INVENTION

Figure 1:
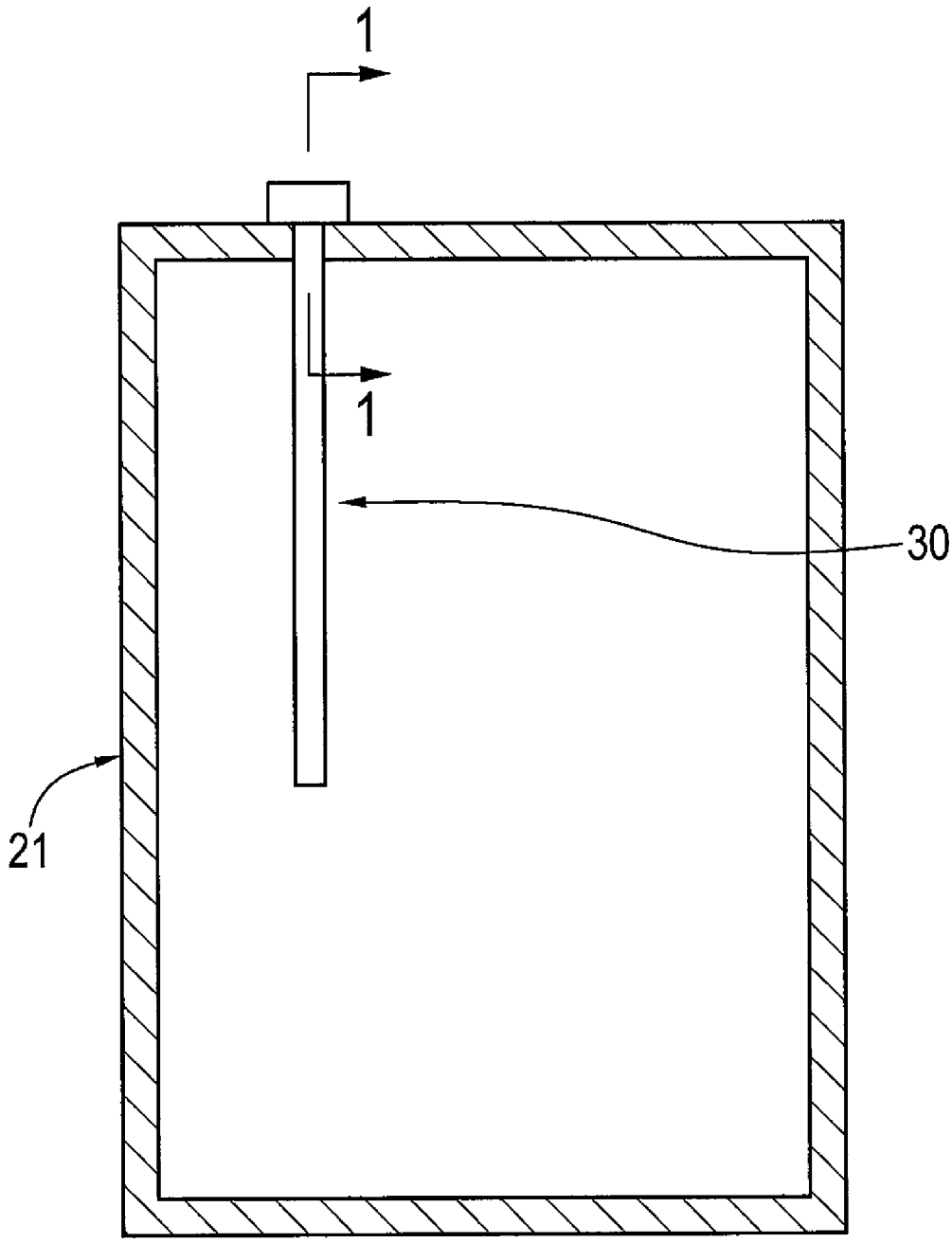
FIG. 1 illustrates a schematic partial cross-sectional view of a water heater tank with on the top an anode of the present invention installed.

FIG. 1 illustrates an inserted cylindrical shaped sacrificial anode assembly 30 in a typical metallic water heater storage tank 21. The sacrificial anode assembly 30 is depicted as being cylindrical in shape but as appreciated by those skilled in the art, need not be limited to that cylindrical shape. From a compositional perspective, the sacrificial anode assembly 30 is typically constructed from light weight electron donor metals such as magnesium, aluminium or zinc. As described in the prior art, the sacrificial anode assembly 30 is commonly installed in the top end wall of the metallic water heater storage tank 21. The sacrificial anode assembly 30 extends into the storage tank 21 normally containing water and by cathodic means protects the inner layer of the storage tank 21 from electrochemical corrosion.

Figure 2:
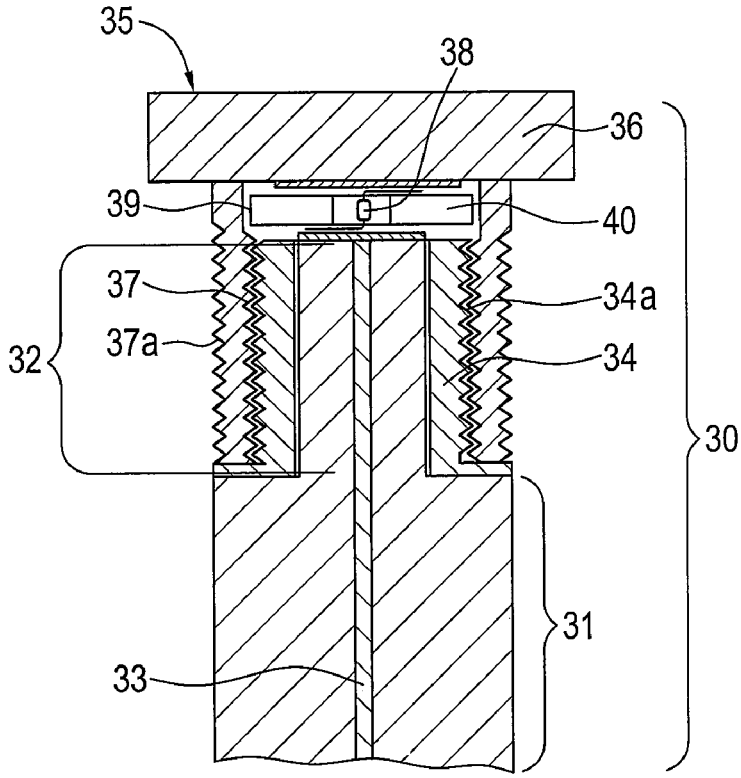
FIG. 2 illustrates a cross-section view of the resistor anode assembly of the present invention taken along line 1-1 of FIG. 1.

FIG. 2 exhibits the cross section 1-1 of the sacrificial anode assembly 30. The sacrificial anode assembly 30 may be further broken down into component parts such as a main body section 31 which extends axially into the storage tank 21, an upper neck section 32 of a diameter that is less than the main section 31 and a metal cap section 35 which is exterior to the storage tank 21 and is fastened to the upper neck section 32. It should be further noted that a steel core wire 33 is disposed axially or longitudinally within the main body section 31 and the upper neck section 32 of the sacrificial anode assembly 30.

To further assist in insulating the sacrificial anode assembly 30 a plastic insulating sleeve 34 mirroring the shape of the upper neck section 32 of the sacrificial anode assembly 30 is placed over the upper neck section 32. The outer surface of the plastic insulating sleeve 34 may be threaded 34*a* to aid in securing the metal cap section 35 to the upper neck section 32 of the sacrificial anode assembly 30.

The metal cap section 35 may have a pronounced head portion 36. This head portion 36 of the metal cap section 35 may be bevelled in any number of shapes (square, rectangular, hexagonal etc) to assist in gripping and fastening the metal cap section 35. In addition, the metal cap section 35 may further comprise two axially disposed pairs of threadings 37, 37*a* extending in a similar length to the upper neck section 32 of the sacrificial anode assembly 30. The internal threads 37 fixedly secure the metal cap section 35 to the external threads 34*a* of the plastic insulating sleeve 34. The external threads 37*a* of the metal cap section 35, may act to fixedly secure the sacrificial anode assembly 30 to the storage tank 21.

The metal cap section 35 further comprises an internal cavity. Housed within the internal cavity, is found an electrical resistor assembly or sub-assembly device 39. The sub-assembly device 39 consists of a resistor such as a barrel shaped resistor 38 disposed within an insulating member such as a plastic ring or disc 40. More particularly the resistor 38 is axially disposed relative to the main body section 31. The details of the sub-assembly 39 are expounded upon in FIG. 3.

Figure 3:
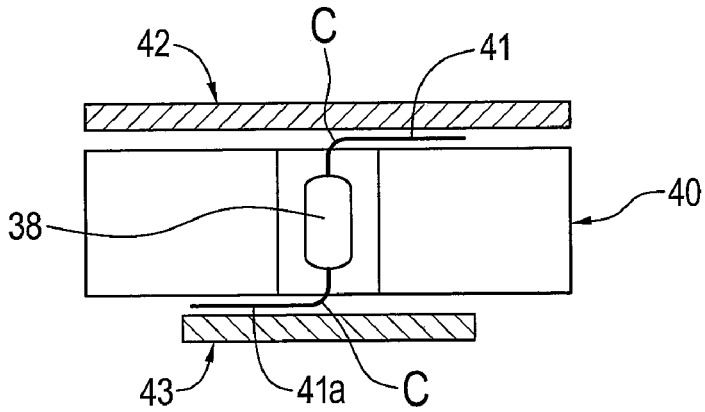
FIG. 3 illustrates an enlarged cross-section view of the resistor assembly of the present invention taken along line 1-1 of FIG. 1.

As depicted in FIG. 3, two metal lead wires 41, 41*a* extend from opposite ends of the barrel-shaped resistor 38 and are both placed in electrical contact with two axially spaced circular metallic sheets or plates respectively 42, 43. In one particular embodiment of the present invention, the wires 41, 41*a* extend from opposite ends of the barrel-shaped resistor 38 and are both welded to the two plates 42, 43 further residing within the internal cavity of the metal cap 35. The first plate 42 may have a slightly smaller diameter to the plastic ring 40 and is fixedly secured on top of the plastic ring 40 whereas the lower plate 43 may have the same diameter as the upper neck section 32 and is also fixedly secured to the plastic ring 40.

As can be appreciated from FIG. 2 and FIG. 3 the conducting wires 41, 41*a* may be bent to extend radially outward within the cavity of the metal cap 35. The wires 41 and 41*a* present generally curved sections C in the region adjacent to the resistor 38. Further the wires 41 and 41*a* are positioned as to accommodate any vibrational force that may be imparted to resist damage. Moreover the entire resistor sub-assembly 39 is further protected within an axial hole disposed with the insulating disc 40.

After the sub-assembly 39 as depicted in FIG. 3 has been placed into the cavity of the metal cap 35, the metal cap 35 may be fixedly secured to the plastic insulating sleeve 34 and to the storage tank 21. Once the metal cap 35 is secured, the pressure exercised on the sub-assembly 39 insures electrical contact and minimizes moisture collection within the metal cap 35. To further minimize moisture formation within the metal cap 35 an epoxy material may be placed at the junction of the metal cap 35, the plastic insulating insert 34 and the main section 31 of the sacrificial anode assembly 30.

The present invention provides an advantage in terms of manufacturing and the positioning of the sub-assembly 39 in the metal cap 35 assists in assuring that a steady electric current flows between the sacrificial anode assembly 30 and the storage tank 21.

It will be appreciated by those skilled in the art that other variations of the one or more embodiments described herein are possible and may be practised without departing from the scope of the present invention

What is claimed is:

1. A sacrificial anode assembly insertable into a liquid storage tank or vessel for cathodic protection, comprising:

a. an elongated metal anode member with a metal core extending from an upper to a lower section;

b. a metal cap engageable with the upper section and having a cavity for receiving an insulating member disposed between the cap and the upper section;

c. a resistor disposed within the insulating member and in electrical contact with a first and second metallic plate, wherein the first metallic plate contacts the metal cap and the second metal cap contacts the upper section of the metal core.

2. The sacrificial anode assembly of claim 1 wherein the insulating member comprises a plastic disc having a first and a second spaced flat surfaces and a hole extending axially between the first and the second flat surface.

3. The sacrificial anode assembly of claim 2 wherein the resistor disposed within the insulating member comprises a barrel shape disposed generally axially within the hole of the plastic disc.

4. The sacrificial anode assembly of claim 3 wherein the barrel shaped resistor includes a first conductor wire radially disposed across the first flat surface of the insulating member and in electrical contact with the first metal plate and a second conductor wire radially disposed across the second flat surface of the insulating member and in electrical contact with the upper section of the metal core.

5. The sacrificial anode assembly of claim 4 wherein the elongated metal anode member is generally cylindrical and the metal core is axially disposed within the metal anode member.

6. The sacrificial anode assembly of claim 5 wherein the metal anode member is selected from the group comprising magnesium, aluminium, and zinc.

7. The sacrificial anode assembly of claim 6 wherein the metal core comprises a metal wire core.

8. The sacrificial anode assembly of claim 7 wherein an insulating sleeve is secured over the upper section of the elongated metal anode member and engageable with the metal cap.

9. The sacrificial anode assembly of claim 8 wherein the insulating sleeve is formed from a plastic material.

10. The sacrificial anode assembly of claim 9 wherein an epoxy material may be placed at the junction of the metal cap, the insulating sleeve, the upper section of the elongated metal anode member and the lower section of the elongated metal anode member to minimize moisture accumulation within said metal cap.

11. A sacrificial anode assembly insertable into a liquid storage tank or vessel for cathodic protection, comprising:

a. an elongated metal anode member with a metal wire core extending axially therethrough from an upper neck section to a main body section wherein the upper neck section of said elongated metal anode is of a reduced diameter to that of the main body section;

b. an insulating sleeve secured over the upper neck section of the elongated metal anode member wherein said insulating sleeve has an external wall with threads to fixedly secure a metal cap;

c. the metal cap having:

i. threads on an internal wall of said metal cap to fixedly secure said metal cap to the insulating sleeve;

ii. a cylindrical receptacle for receipt of an end of the upper neck section of the elongated metal anode member and an electrical resistor assembly; and d. the electrical resistor assembly disposed within the metal cap comprising:

i. a barrel-shaped resistor body located in the centre of a plastic ring;

ii. two lead wires welded respectively to an upper metallic plate and a lower metallic plate separated by the plastic ring.

12. The sacrificial anode assembly of claim 11 wherein the electrical resistor assembly is interposed between a bottom flat surface of the metal cap and a top flat surface of the upper neck section of the elongated metal anode member.

13. The sacrificial anode assembly of claim 12 wherein the electrical resistor assembly achieves electrical contact with both the metal cap and the top flat surface of the upper neck section of the elongated metal anode member once the metal cap is fixedly secured to the insulating sleeve.

14. The sacrificial anode assembly of claim 13 wherein the plastic ring separates the upper metallic plate of a similar diameter as said plastic ring and the lower metallic plate of a similar diameter as the upper neck section of the elongated metal anode member.

15. The sacrificial anode assembly of claim 14 wherein the upper metallic plate and the lower metallic plate are fixedly attached to the plastic ring.

16. The sacrificial anode assembly of claim 15 wherein the metal cap further comprises threads on an external wall of the metal cap to fixedly secure the sacrificial anode assembly to a storage container.

17. The sacrificial anode assembly of claim 16 wherein the threads of the metal cap are of a similar length to the upper neck section of the elongated metal anode member.

18. The sacrificial anode assembly of claim 17 wherein the insulating sleeve is formed from a plastic material.

19. The sacrificial anode assembly of claim 18 wherein an epoxy material may be placed at the junction of the metal cap, the insulating insert and the main section of the elongated metal anode member to minimize moisture accumulation within said metal cap.

20. A method of assembling a sacrificial anode assembly having an elongated anode member or metal core extending between an upper and a lower section and a metal cap having a cavity for receiving an insulating disc with a hole therethrough:

a. placing a barrel shaped resistor having conduction wires at opposite ends thereof through the hole of the insulating disc;

b. bending the conductor wires of the barrel shaped resistor over the ends of the insulating disc respectively;

c. placing a first metal plate into the cavity of the metal cap for contact therewith;

d. placing the insulating disc carrying the barrel shaped resistor with the bent conductor wire into the cavity of the metal cap wherein one of the bent conductor wires contact the first metal plate;

e. placing a second metal plate between the second bent conductor wire and the metal core for electrical contact therewith;

f. securing the metal cap to the elongated metal anode member.

* * * * *